US006510855B1

(12) United States Patent
Korte et al.

(10) Patent No.: US 6,510,855 B1
(45) Date of Patent: Jan. 28, 2003

(54) TOBACCO RECOVERY SYSTEM

(75) Inventors: Kevin Korte, Macon, GA (US); Michael Wuolukka, Lizella, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 2 days.

(21) Appl. No.: 10/084,595

(22) Filed: Feb. 27, 2002

Related U.S. Application Data

(62) Division of application No. 09/513,993, filed on Mar. 3, 2000, now Pat. No. 6,371,126.

(51) Int. Cl.[7] ..... A24B 3/00; A24C 5/00; A24C 5/39

(52) U.S. Cl. ..... 131/96; 131/300; 131/301; 131/302; 131/304

(58) Field of Search ..... 131/84.3, 29, 96, 131/110, 300, 302, 301, 304, 306, 109.2; 209/139.1, 139.2, 142, 143, 154

(56) References Cited

U.S. PATENT DOCUMENTS

| | | | | | |
|---|---|---|---|---|---|
| 3,034,514 | A | * | 5/1962 | Pinkham | 131/110 |
| 3,362,414 | A | * | 1/1968 | Wochinowski | 131/110 |
| 3,608,716 | A | * | 9/1971 | Rowell et al. | 209/139.1 |
| 4,055,192 | A | | 10/1977 | Berlin et al. | |
| 4,251,356 | A | | 2/1981 | Harte | |
| 4,446,876 | A | * | 5/1984 | Brackman | 131/109.1 |
| 4,458,698 | A | | 7/1984 | Brackmann | |
| 4,475,562 | A | | 10/1984 | Thatcher et al. | |
| 4,587,979 | A | | 5/1986 | Hagemann et al. | |
| 4,600,021 | A | * | 7/1986 | Mattei | 131/109.2 |
| 4,625,736 | A | * | 12/1986 | Rothchild | 131/296 |
| 4,721,561 | A | * | 1/1988 | Oetiker et al. | 209/139.1 |
| 4,932,423 | A | | 6/1990 | Lauenstein et al. | |
| 4,938,235 | A | * | 7/1990 | Hirsch et al. | 131/109.2 |
| 5,063,944 | A | | 11/1991 | Parker | |
| 5,083,577 | A | | 1/1992 | Cullen | |
| 5,199,448 | A | | 4/1993 | Parker | |

FOREIGN PATENT DOCUMENTS

| | | | | |
|---|---|---|---|---|
| EP | 0588543 | * | 12/1997 | A24B/5/10 |
| FR | 584332 | * | 2/1925 | |
| GB | 2183502 | * | 6/1987 | B65G/53/60 |
| GB | 2262429 | * | 6/1993 | A24C/5/39 |
| GB | 2264855 | * | 9/1993 | A24C/5/39 |

* cited by examiner

*Primary Examiner*—Steven P. Griffin
*Assistant Examiner*—Carlos Lopez
(74) *Attorney, Agent, or Firm*—Charles G. Lamb; John F. Salazar; Middleton Reutlinger

(57) ABSTRACT

A cigarette manufacturing system includes a feed hopper for feeding cut tobacco at a preselected rate to a cigarette rod forming device which in turn feeds formed cigarette rods to a filter tip attaching device. A tobacco recovery system is provided which includes air conveying conduits in flow communication with the rod forming device, the filter tip attachment device and a tobacco dust and useable tobacco particle separator wherein particles of tobacco dust and useable tobacco particles recovered from the rod forming section of the cigarette maker and the filter tip attaching device are separated. The useable particles are re-fed back into the feed hopper. The tobacco dust is transferred to a tobacco dust recovery collector. The tobacco dust and useable tobacco particles separator include a centrifugal curved conduit in combination with a classifying chamber having a bottom outlet for removing useable tobacco and a top outlet for removing tobacco dust.

32 Claims, 2 Drawing Sheets

TOBACCO RECOVERY SYSTEM

CROSS-REFERENCE TO RELATED APPLICATIONS

This utility patent application is a divisional of U.S. patent application Ser. No. 09/513,993, filed on Mar. 3, 2000, now U.S. Pat. No. 6,371,126 which issued Apr. 16, 2002.

BACKGROUND OF THE INVENTION

The present invention relates to a tobacco recovery system and more particularly to a system for separating useable tobacco particles from dust at selected locations in a cigarette making process and returning the useable particles into the feed end of the cigarette making process.

Presently in the cigarette making process, tobacco is fed from a cut tobacco feed source to a hopper for feeding tobacco at a metered rate to a cigarette rod forming section of a cigarette making machine. The transfer of the cut tobacco from the feed source to the hopper for the cigarette making machine is generally accomplished by air conveying through appropriate conduits or feed pipes at relatively high speed. The cut tobacco in the hopper is then fed to the cigarette rod forming machine wherein cigarette wrapper paper is fed into the machine and through a garniture wraps selected amounts of tobacco into a long rod which is then cut into sections and fed to a filter tip attachment machine or section of a cigarette making machine wherein cut filter tips are attached to the cigarette rods. Dust and small useable particles of tobacco evolve during the cigarette rod forming as well as the filter tip attaching processing steps. Dust recovery systems are generally provided wherein the vacuum side of the dust recovery systems include appropriate piping attached to the cigarette rod forming and filter tip attaching sections whereby the evolving dust and light or small useable tobacco particles are transported to a dust collection container. The dust and tobacco particles in the dust collection container can then be used as feed for reconstituted tobacco.

SUMMARY OF THE INVENTION

An object of the present invention is to recover useable cut tobacco particles during the cigarette making process.

It is also an object of the present invention to reintroduce recovered useable tobacco particles directly into the feed end of a cigarette making machine.

It is a further object of the present invention to provide a control system capable of managing the recovery of tobacco particles from a cigarette making and filter attaching steps of a cigarette making process and reintroduce useable tobacco particles into the feed end of the cigarette making process.

More particularly, the present invention provides a tobacco recovery system in combination with a cigarette maker comprising: a feed hopper having a first inlet in flow communication with a tobacco feed source, a second inlet in flow communication with a tobacco dust recovery system and a tobacco discharge outlet; a cigarette rod forming section of the cigarette maker having a tobacco inlet in flow communication with the tobacco discharge outlet from the feed hopper, a tobacco rod discharge, and an opening in flow communication with a tobacco dust recovery system; a filter tip attachment section of a cigarette maker having the tobacco rod inlet in flow communication with the tobacco rod discharge, a completed cigarette discharge outlet, and an opening in flow communication with the tobacco dust recovery air stream; and, the tobacco air recovery air stream having an outlet in flow communication with an inlet to the tobacco dust recovery air stream separator, the tobacco recovery air stream separator having a first outlet in flow communication with the feed hopper and a second outlet in flow communication with a dust collector. Preferably the tobacco dust recovery air stream separator includes a solids separating device, such as a tangential separator, screen type separator or centrifugal curved conduit having an inlet in flow communication with the tobacco air recovery air stream outlet, an outlet in flow communication with said dust collector and an outlet in flow communication with an inlet to a vertically disposed solids classification chamber, such as a fluidized bed. The solids classification chamber includes a large particle outlet disposed in a bottom of said classification chamber and a small particle outlet disposed in a top of said classification chamber.

BRIEF DESCRIPTION OF THE DRAWINGS

A better understanding of the invention will be had upon reference to the following description in conjunction with the accompanying drawing in which like numerals refer to like parts throughout the Figure and wherein.

DESCRIPTION OF THE PREFERRED EMBODIMENT

Figure 1:
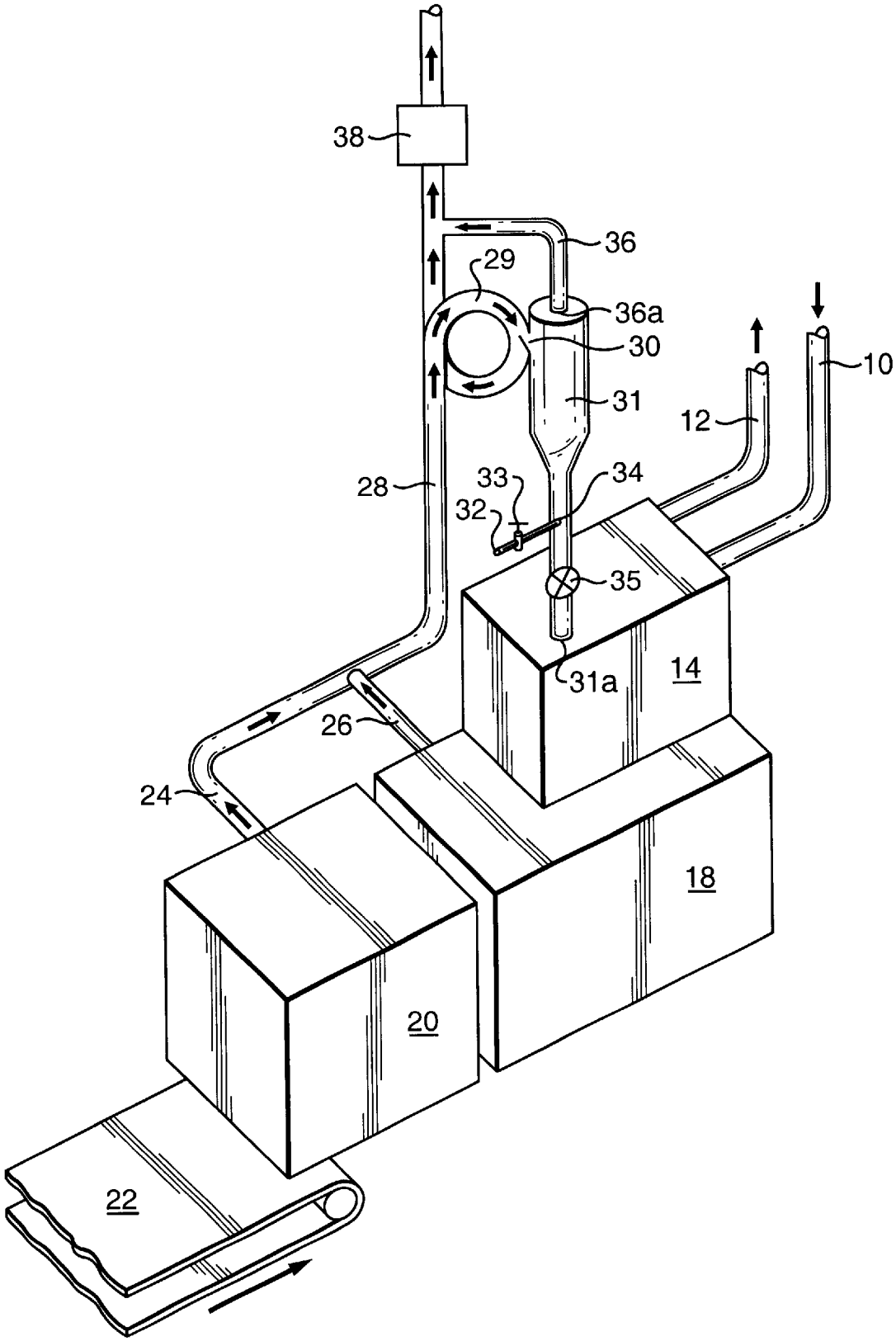
FIG. 1 is a schematic representation, in perspective, of one preferred embodiment of a tobacco recovery system of the present invention.
Figure 2:
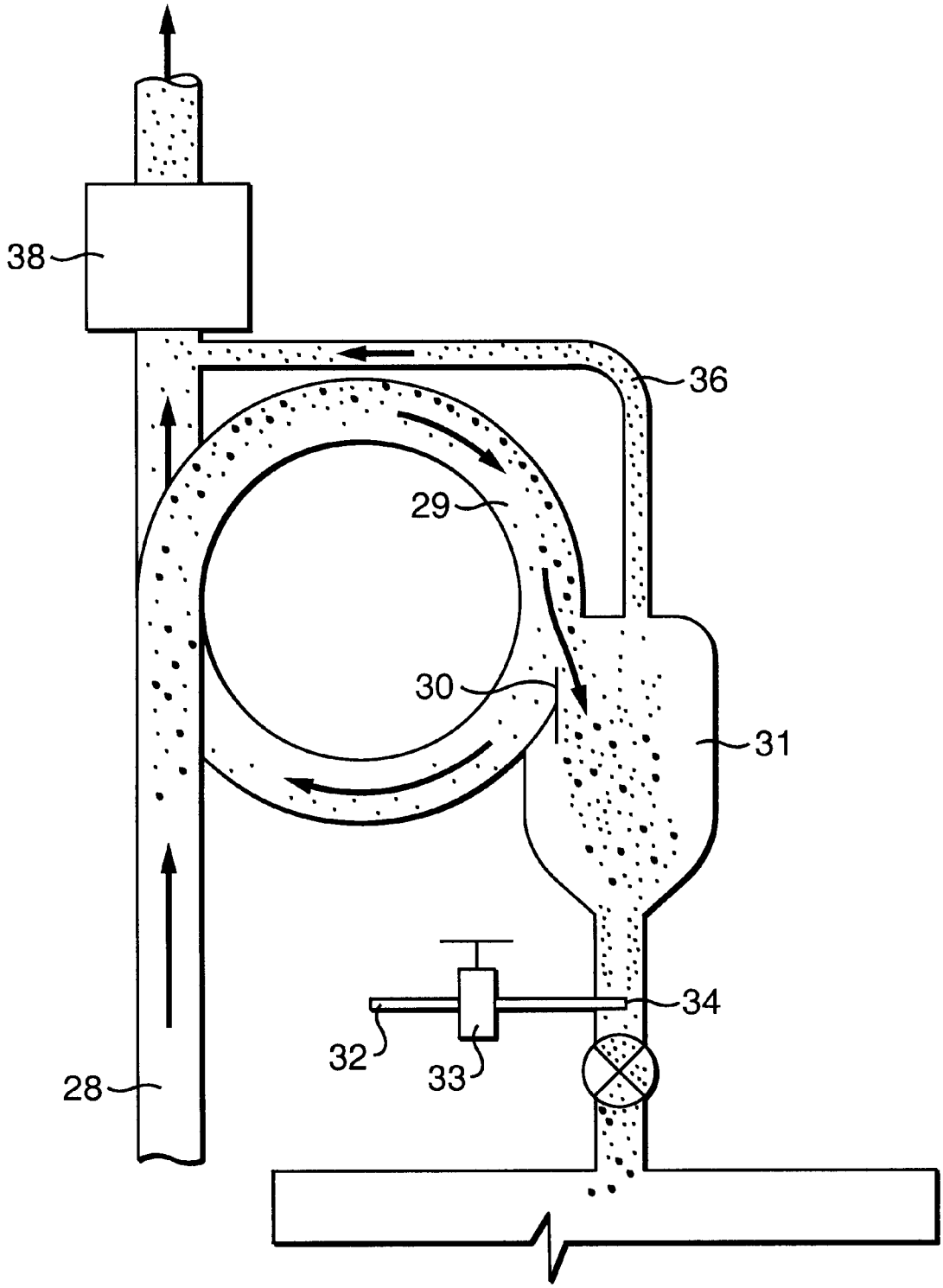
FIG. 2 is a schematic representation showing the flow of tobacco particles in the system of FIG. 1.

With reference to the Figures, there is shown a feed conduit 10 from a cut tobacco source (not shown) for making cigarettes. The feed conduit 10 is in flow communication with a feed hopper 14 having a gravity discharge or tobacco discharge outlet into a rod forming section 18 of a cigarette maker. The cigarette maker, including an associated filter tip attachment machine identified by numeral 20, may be any commercially available cigarette maker. A pneumatic feed vacuum conduit 12, also in flow communication with the feed hopper 14, is included to provide the means for the tobacco to flow from the tobacco source through the feed conduit 10 to the feed hopper 14. The feed conduit 10 and pneumatic feed vacuum conduit 12 are separated by a screen (not shown) located in the feed hopper 14.

In the rod forming section 18, the tobacco adheres to a suction tape (not shown) with one side of the rod forming section 18 being in flow communication with a rod forming vacuum conduit 26. Upon the formation of a cigarette rod, by known methods, the product within the rod forming section 18 is conveyed to the filter tip attachment section 20. In the filter tip attachment section 20 the cigarette rods are conveyed along a series of drums (not shown) and filter tips are attached to the cigarette rods by known methods. The cigarette rods and filter tips are held in position on the outer perimeter of the drums by holes in the drums that are in flow communication with the filter tip attachment vacuum conduit 24. During this processing, particles of tobacco and tobacco dust become entrained in the vacuum and flow through the rod forming vacuum conduit 26 and filter tip attachment vacuum conduit 24. Resulting cigarette product from filter tip attachment section 20 is carried away for packaging by transfer conveyor 22.

Upon exiting the filter tip attachment section 20 of the cigarette maker the rod forming vacuum conduit 26 and filter tip attachment vacuum conduit 24 may or may not join into a main vacuum conduit 28. In any case, the present invention is equally applicable to a system wherein each vacuum conduit (24 and/or 26) may a be used individually or in flow communication with a main vacuum conduit 28 as shown.

In the present invention, some or all of the tobacco particles and tobacco dust are removed from the main vacuum conduit 28 by first providing the main vacuum conduit 28 to be in flow communication with a particle separator, such as a tangential separator, a screen type separator or, as exemplified, a centrifugal curve 29. This centrifugal curve 29 must be of a sufficient degree so that, when coupled with the tobacco particle velocity, the tobacco particles are forced along the outside wall of the centrifugal curve 29. A 360 curve is used for purposes of illustration in the figures provided.

"A particles classification chamber 31, such as a fluidized bed, is also provided, chamber 31 having a first inlet in flow communication with the centrifugal curve 29 of the main vacuum conduit 28, a second inlet in flow communication with a classifying nozzle 34, a first outlet in flow communication at 31 a with the feed hopper 14 and possibly a second outlet in flow communication at 36*a* with a dust removal conduit 36. Further, the classification chamber 31 is in flow communication with the main vacuum conduit 28 utilizing a scalping gate 30 which separates large particles accumulating along the outside walls of curve 29 from the smaller, lighter particles in the airstream passing thereby. As can be seen, the classification chamber 31 is adjacent to and in flow communication with centrifugal curve 29. Scalping gate 30 is interposed between curve 29 and chamber 31 such that air flow between the two must pass by gate 30. Scalping gate 30 is adjustable in this interposed position and may extend into said curve an adjustable distance, said distance dictated by the curvature of curve 29, pressure within air flow conduit 28, size and type of classification chamber 31 as well as other factors. Adjustment of scalping gate within the airflow entrains the tobacco particles entrained in the airflow and forces the heavier particles which would be nearer the outside edge of curve 29 into the chamber 31. Fine adjusting of the gate 30 therefor captures larger or smaller particles depending on the distance which the gate enters into curve 29 or the adjacency point between curve 29 and chamber 31."

The tobacco particles and dust in the particle separator 31 are separated by scalping gate 30 through a combination of the airflow of main vacuum conduit 28, degree of curve 29 and size of chamber 31. This classification may additionally be aided through the optional use of classifying air flow through the upwardly directed classifying nozzle 34. This classifying airflow to nozzle 34 is supplied by an airline 32 which is in flow communication with a high pressure air source and controlled by an air flow regulator 33. Regulator 33 may be used to adjust the flow so that the airflow through the classifying nozzle 34 entrains smaller tobacco particles and dust in the classification chamber 31 and causes them to exit, in one example of the present invention, through the dust removal conduit 36. The classifying airflow travels from the classifying nozzle 34 up through the classification chamber 31 and out the dust removal conduit 36. The optimal dust removal conduit 36 is in flow communication with the main vacuum conduit 28 at a location upstream of the centrifugal curve 29 and below an optional in-line blower 38. The in-line blower 38, if present, provides additional air flow to the main vacuum conduit 28 so that the present invention does not impact the functioning of the rod forming section 18 and filter tip attachment section 20 of the cigarette maker.

Alternatively, dust removal conduit 36 may not be utilized wherein scalping gate 30 may, with the proper air flow in conduit 28, remove those particles sought to be recycled. Thus, removal conduit 36 can be taken out of the design if the particle size, chamber 31 design and other factors work in adequate conjunction to separate particles flowing in curve 29. Further, regulator 33 may alternatively be utilized or removed depending upon the air flow characteristics and shape of collector 31. Hence variations within the disclosed inventive design are possible by one of the ordinary skill in the art and modifications may be made dependent upon these airflow and system characteristics without undo experimentation.

The larger tobacco particles not captured by the classification airflow fall to the bottom of the classification chamber 31 until they reach a metering device, such as, the rotary airlock 35. The rotary airlock 35, which is a commercially available unit from, for example, Cardwell, separates the classification chamber 31 from the feed hopper 14 and controls the rate at which the larger tobacco particles are Introduced into the feed hopper 14.

Even though it is shown that conduits 24 and 26 are in flow communication with the main vacuum conduit 28, it is realized that one of these conduits 24 or 26 may be in flow communication with a second tobacco recovery vacuum conduit.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A cigarette making system having a tobacco recovery system in combination with a cigarette making machine comprising:

a feed hopper having a first inlet in flow communication with a cut tobacco feed source, a second inlet in flow communication with a tobacco dust and useable tobacco particle separator, and a tobacco discharge outlet;

a cigarette rod forming section of said cigarette making machine having a tobacco inlet in flow communication with said feed hopper tobacco discharge outlet, a tobacco rod discharge, and an opening in the rod forming section in flow communication with a first tobacco recovery air stream;

a filter tip attachment section of said cigarette making machine having a tobacco rod inlet in flow communication with said tobacco rod discharge of said cigarette rod forming section, a completed cigarette discharge outlet, and an opening in flow communication with a second tobacco recovery air stream; and, at least one of said first or said second tobacco recovery air streams being in flow communication with said tobacco dust and useable tobacco particles separator, said separator having a first outlet in flow communication with said second inlet to said feed hopper and a second outlet in flow communication with a tobacco dust recovery collector.

2. The cigarette making system of claim 1, said tobacco dust and useable tobacco particle separator including means to separate useable tobacco particles of preselected size from tobacco dust.

3. The cigarette making system of claim 1, said separator including a centrifugal curved conduit and a classification chamber.

4. The cigarette making system of claim 3, said separator including a classifying airflow at a selected location within a lower portion of said separator.

5. The cigarette making system of claim 4, said classifying airflow being supplied air at a regulated flow and pressure rate.

6. The cigarette making system of claim 1 including a metering device between said feed hopper and said rod forming section of said cigarette making machine.

7. The cigarette making system of claim 1, said separator having a first outlet in flow communication with said second inlet to said feed hopper and a second outlet in flow communication with a tobacco dust recovery collector.

8. The tobacco recovery system of claim 1, said first and said second tobacco recovery air streams being the same tobacco recovery air stream.

9. A cigarette making system comprising:

a. a cigarette making machine, comprising;
   a rod forming section in flow communication with a rod forming vacuum conduit; and
   a feed hopper having a gravity discharge into said rod forming section, and said hopper being in flow communication with a feed conduit from a cut tobacco source and with a pneumatic feed vacuum conduit, said pneumatic feed vacuum conduit being physically separated from said feed conduit; and b. a tobacco recovery system, comprising;
   a particle separator having a first inlet, a first outlet, and a second outlet, said first inlet being in flow communication with said cigarette making machine rod forming vacuum conduit;
   a vertically disposed classification chamber having an inlet in flow communication with said particle separator first outlet, a large particle outlet disposed in a bottom of said classification chamber and being in flow communication with said feed hopper, and a small particle outlet disposed in a top of said classification chamber; and
   an airflow source to move tobacco dust and useable tobacco particles from said rod forming section to said particle separator and said classification chamber.

10. The system of claim 9, said particle separator being a centrifugal curved conduit.

11. The system of claim 10, said centrifugal curved conduit being oriented in a substantial vertical position with flow of tobacco dust and particles being upwards into said first inlet, downwards at said first outlet and upwards at said second outlet.

12. The system of claim 10, said centrifugal curved conduit being curved up to 360 degrees.

13. The system of claim 9, said air flow source being a vacuum source in flow communication with said second outlet from said particles separator.

14. The system of claim 9 including a scalping gate at said particle separator.

15. The system of claim 9 including means to introduce air into a bottom of said classification chamber, said means to introduce air including a conduit into said classification chamber with a nozzle on the termination end thereof, said nozzle being positioned to direct air upwards into said chamber.

16. The system of claim 15, said means to introduce air including an air flow regulator.

17. The system of claim 9, said classification chamber large particles outlet being in flow communication with said cigarette making machine, said small particle outlet being in flow communication with a tobacco dust recovery collector.

18. The system of claim 9 wherein said cigarette making machine further includes a filter tip attachment machine downstream of said rod forming section.

19. The system of claim 10 wherein said filter tip attachment machine is in flow communication with a filter tip attachment vacuum conduit.

20. The system of claim 9 wherein said cigarette making machine pneumatic feed vacuum conduit is separated from said feed conduit by a screen mounted within said feed hopper.

21. The system of claim 9 wherein said rod forming vacuum conduit is in flow communication with a main vacuum conduit.

22. The system of claim 19 wherein said filter tip attachment vacuum conduit is in flow communication with a main vacuum conduit.

23. The apparatus of claim 9 further including a filter tip attachment section in flow communication with said cigarette rod forming section.

24. The apparatus of claim 9, said particle separator being a tangential separator.

25. The apparatus of claim 9, said particle separator being a screen type separator.

26. A cigarette making system comprising:

a. a cigarette making machine, comprising:
   a rod forming section in flow communication with a rod forming vacuum conduit; and
   a feed hopper having a gravity discharge into said rod forming section, and said hopper being in flow communication with a feed conduit from a cut tobacco source and with a pneumatic feed vacuum conduit, said pneumatic feed vacuum conduit being physically separated from said feed conduit; and b. a tobacco recovery system, comprising:
   a centrifugal curve in flow communication with said cigarette making machine rod forming vacuum conduit;
   a classification chamber adjacent said centrifugal curve and in flow communication with said feed hopper;
   a scalping gate interposed between said classification chamber and said centrifugal curve; and
   an air lock interposed between said feed hopper and said chamber.

27. The system of claim 26 wherein said vacuum source is in flow communication with a filter tip attachment conduit.

28. The system of claim 27 wherein said vacuum source is additionally in flow communication with a rod forming vacuum conduit.

29. The system of claim 26 wherein said centrifugal curve extends between 30 and 360 degrees.

30. The system of claim 26 wherein said scalping gate between said centrifugal curve and said classification chamber is adjustable in height.

31. The system of claim 26 further comprising:

a dust removal conduit in flow communication with said classification chamber; a classification nozzle within said classification chamber, said nozzle in flow communication with a high pressure air source; and, a valve interposed between said air source and said nozzle.

32. The system of claim 26 wherein said classification chamber is comprised of a tangential separator.

* * * * *